US007700861B1

(12) United States Patent
Robbins

(10) Patent No.: US 7,700,861 B1
(45) Date of Patent: Apr. 20, 2010

(54) STRINGED MUSICAL INSTRUMENT

(76) Inventor: Milton J. Robbins, P.O. Box 10243, Truckee, CA (US) 96162

( * ) Notice: Subject to any disclaimer, the term of this patent is extended or adjusted under 35 U.S.C. 154(b) by 0 days.

(21) Appl. No.: 12/423,735

(22) Filed: Apr. 14, 2009

(51) Int. Cl.
*G10D 1/10* (2006.01)

(52) U.S. Cl. ..... 84/267; 446/318

(58) Field of Classification Search ..... 84/267, 84/284, 285, 293, 264–266; 446/318, 265, 446/285

See application file for complete search history.

(56) References Cited

U.S. PATENT DOCUMENTS

| | | | |
|---|---|---|---|
| 456,027 | A | 7/1891 | Ernst |
| 790,029 | A | 5/1905 | Childs |
| 796,878 | A | 8/1905 | Spurgeon |
| 892,908 | A | 7/1908 | Sorglechner |
| 1,401,158 | A | 12/1921 | Kent |
| 1,848,920 | A | 3/1932 | Watson |
| 3,447,411 | A | 6/1969 | Bloxsom, Jr. |
| D246,869 | S | 1/1978 | Ledford |
| 4,112,804 | A | 9/1978 | Cecchini |
| 4,481,855 | A | 11/1984 | Bozung |

*Primary Examiner*—Kimberly R Lockett
(74) *Attorney, Agent, or Firm*—Crossley Patent Law; Mark Ashley Crossley

(57) ABSTRACT

A stringed musical toy that allows an individual to play notes on the various strings and alter their pitch by changing the configuration of the string bar end. The stringed musical toy has a generally tapered design, resulting in one wide end and one narrow end. A quartet of strings is located within the housing, and can be plucked through a circular opening found on the front panel. The stringed musical toy also has an acoustic pickup, allowing an individual to connect the stringed musical toy to an amplifier, signal processing unit, recorder, or other similar device.

2 Claims, 6 Drawing Sheets

STRINGED MUSICAL INSTRUMENT

BACKGROUND OF THE INVENTION

The present invention concerns that of a stringed musical toy that allows an individual to pluck strings creating notes and to alter the pitch of the notes by squeezing a pair of levers.

SUMMARY OF THE INVENTION

The present invention concerns that of a stringed musical toy that allows an individual to play notes by plucking various strings and to alter the note pitch by squeezing a pair of levers. The toy has a generally tapered housing with a wide end and an opposite narrow end. A quartet of strings is located within the housing, and can be plucked through a circular opening located in the center of the front panel. The stringed musical toy also has an acoustic pickup, allowing an individual to connect the stringed musical toy to an amplifier, signal processing unit, recorder, or other similar device. The back panel is removable.

There has thus been outlined, rather broadly, the more important features of a stringed musical toy that the detailed description thereof that follows may be better understood and in order that the present contribution to the art may be better appreciated. There are, of course, additional features of the stringed musical toy that will be described hereinafter and which will form the subject matter of the claims appended hereto.

In this respect, before explaining at least one embodiment of the stringed musical toy in detail, it is to be understood that the stringed musical toy is not limited in its application to the details of construction and to the arrangements of the components set forth in the following description or illustrated in the drawings. The stringed musical toy is capable of other embodiments and being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present stringed musical toy. It is important, therefore, that the claims be regarded as including such equivalent constructions insofar as they do not depart from the spirit and scope of the present invention.

It is therefore an object of the present invention to provide a stringed musical toy which has all of the advantages of the prior art and none of the disadvantages.

It is another object of the present invention to provide a stringed musical toy which may be easily and efficiently manufactured and marketed.

It is another object of the present invention to provide a stringed musical toy which is of durable and reliable construction.

It is yet another object of the present invention to provide a stringed musical toy which is economically affordable and available for relevant market segment of the purchasing public.

Other objects, features and advantages of the present invention will become more readily apparent from the following detailed description of the preferred embodiment when considered with the attached drawings and appended claims.

DESCRIPTION OF THE PREFERRED EMBODIMENT

Figure 1:
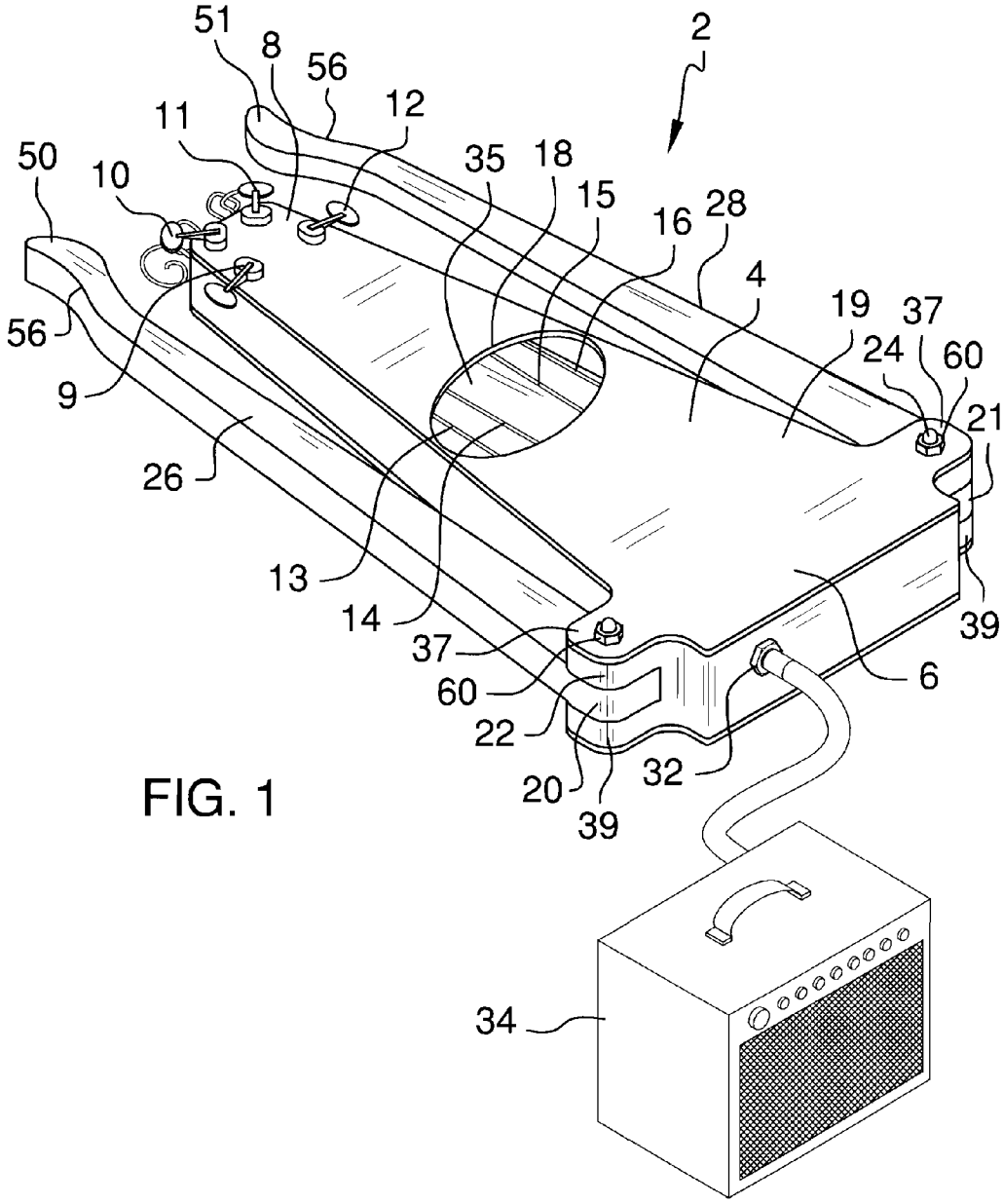
FIG. 1 shows a perspective view of the stringed musical toy.
Figure 2:
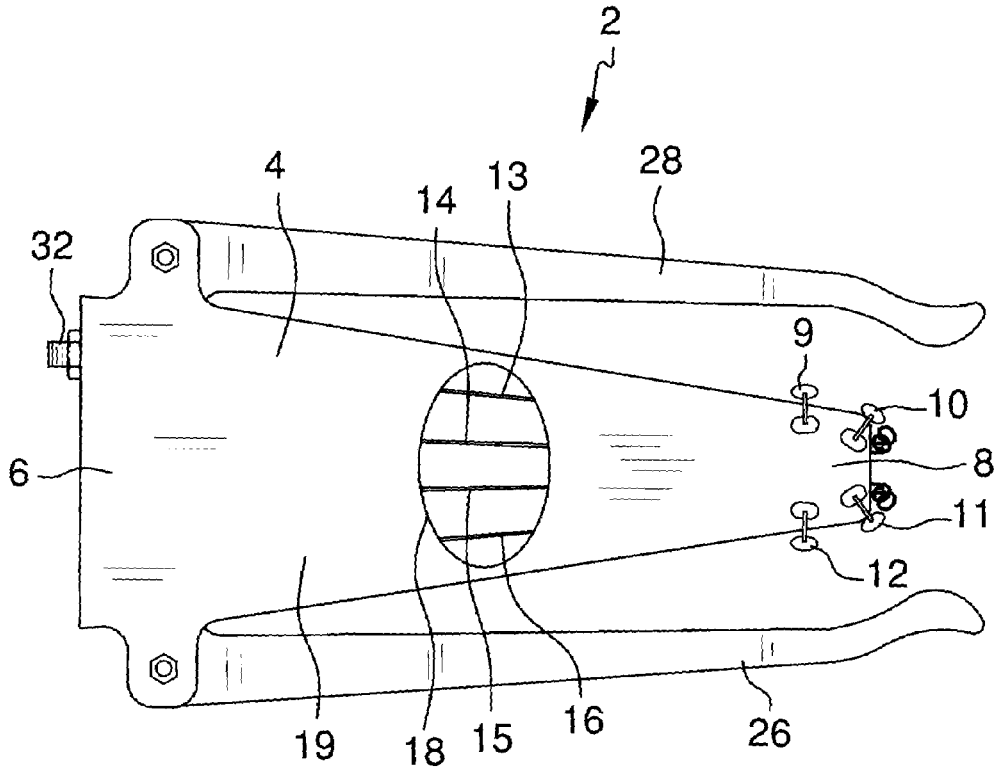
FIG. 2 shows a front view of the stringed musical toy.
Figure 3:
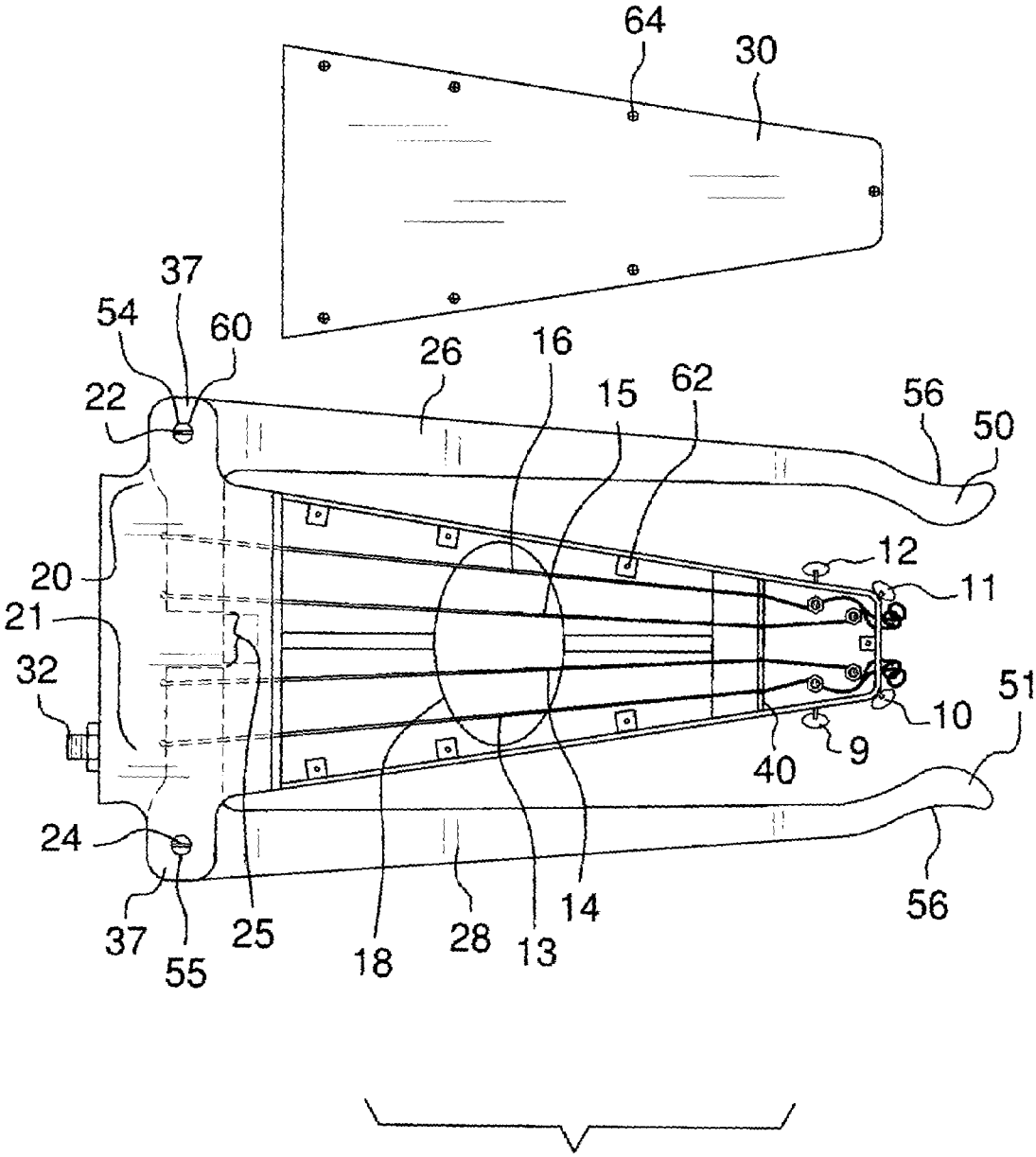
FIG. 3 shows a rear view of the stringed musical toy after the back panel of the stringed musical toy has been removed.
Figure 4:
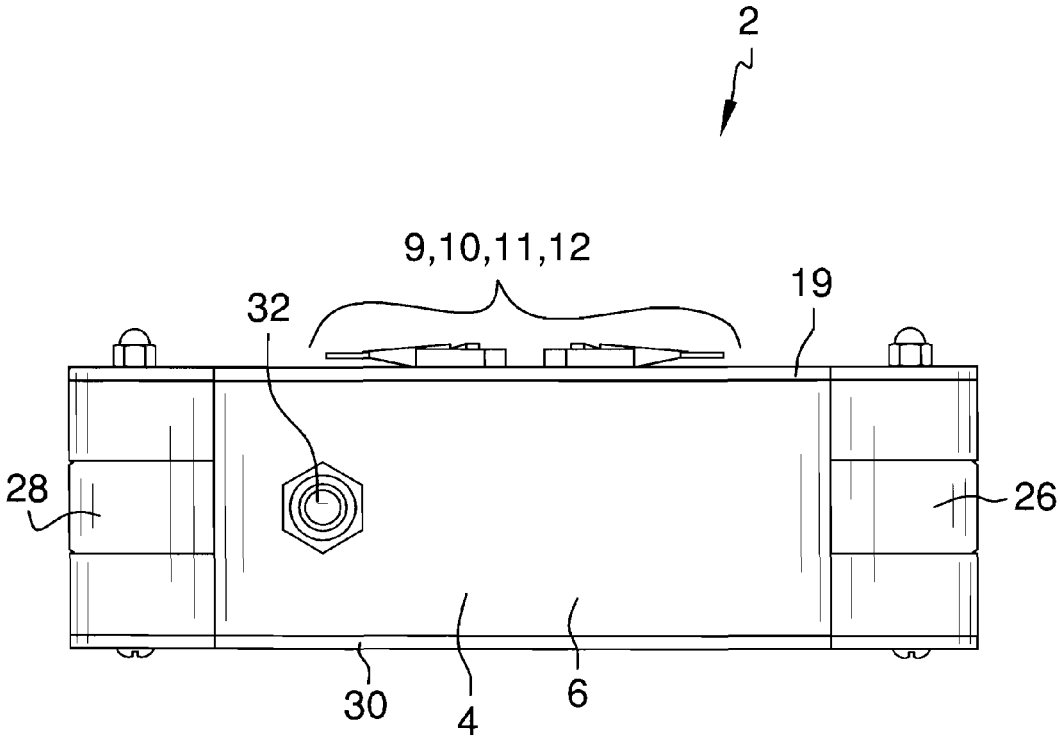
FIG. 4 shows a wide end view of the stringed musical toy.
Figure 5:
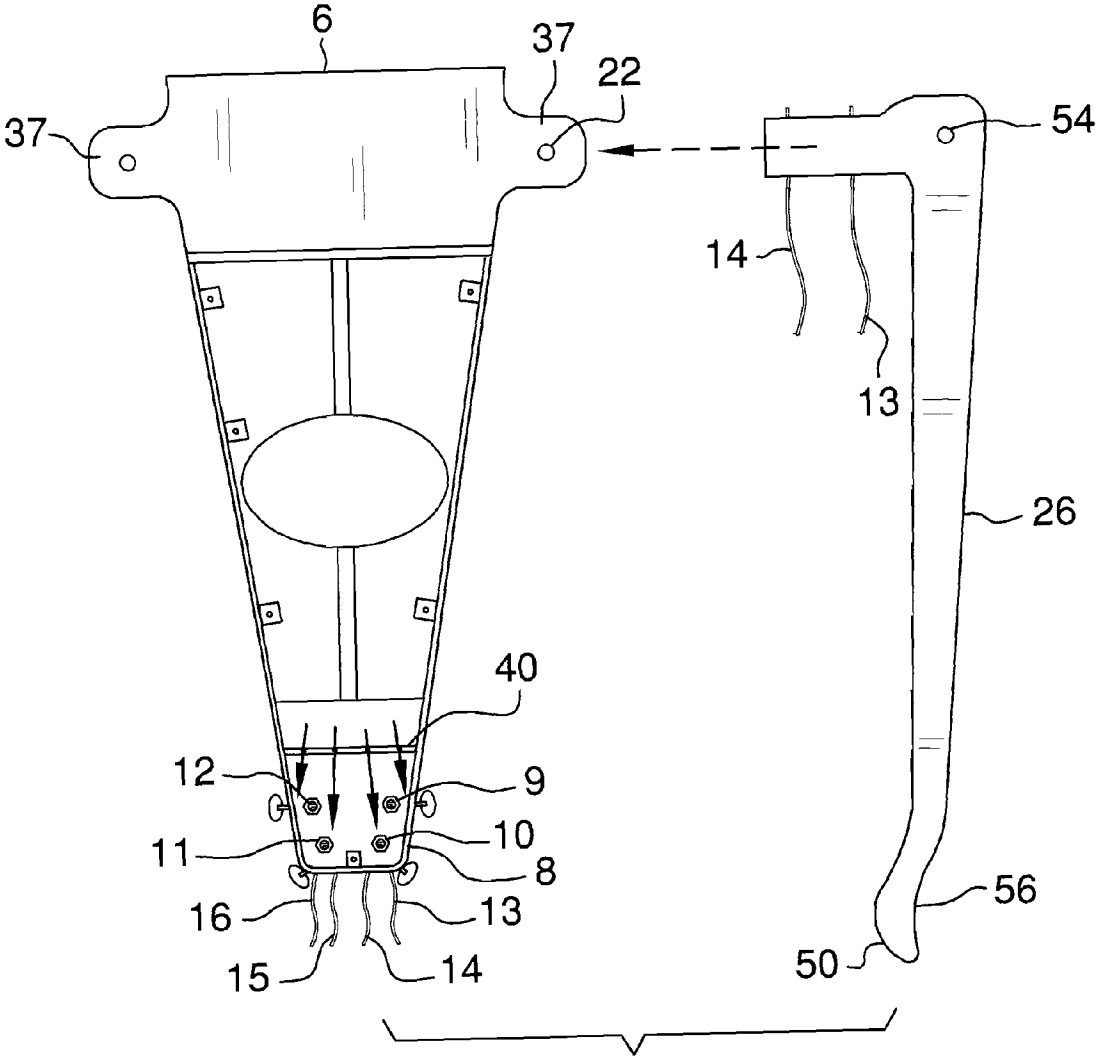
FIG. 5 shows a front view illustrating operation.
Figure 6:
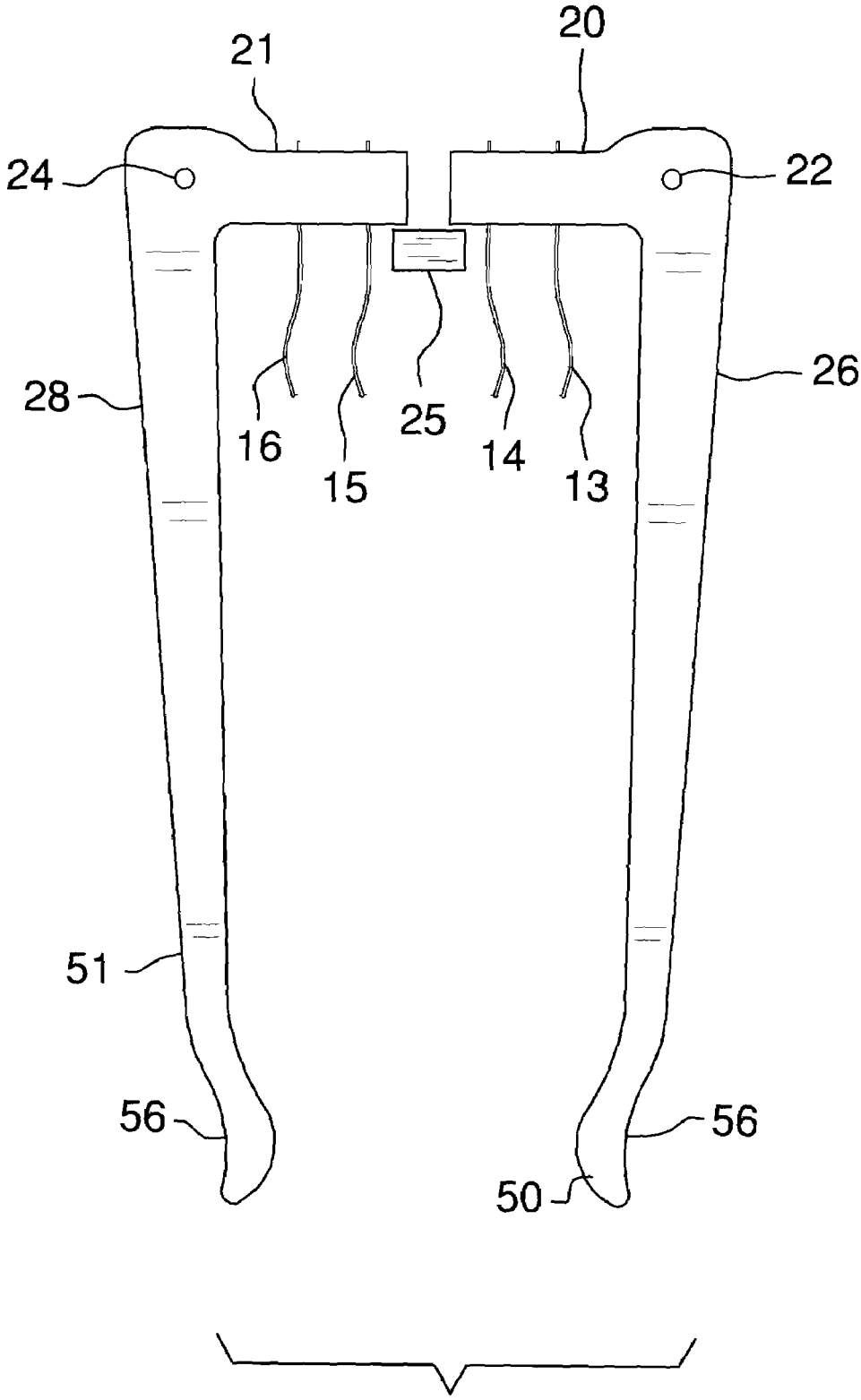
FIG. 6 shows a top view of a pair of levers and a string stop bar.

With reference now to the drawings, and in particular to FIGS. 1 through 6 thereof, a stringed musical stringed toy embodying the principles and concepts of the present invention and generally designated by the reference numeral 2 will be described.

As best illustrated in FIGS. 1 through 6, the stringed musical toy 2 comprises a housing 4 that is preferably a tapered box having a hollow interior 35. The housing 4 has two ends comprising a wide end 6 and a narrow end 8, with the width of the housing 4 gradually lessening as it traverses from the wide end 6 to the narrow end 8. The housing also has a front panel 19 and a back panel 30. The back panel 30 has a plurality of screw mounts 62 and removably attaches to the front panel 19 via a plurality of screws 64 engaging the screw mounts 62. On the wide end 6, the front panel 19 and the back panel 30 comprise a pair of first ears 37 and second ears 39, respectively, extending outwardly perpendicular to the strings. The pair of first ears 37 and the pair of second ears 39 are vertically aligned. A first pivot slot 22 continuously runs through one of the pair of first ears 37 and one of the pair of second ears 39. A second pivot slot 24 continuously runs through an opposite one of the pair of first ears 37 and the opposite one of the pair of second ears 39. The first pivot slot 22 and the second pivot slot 24 removably receive a bolt 60 to create a pivot point. The dimensions of the housing 4 are preferably a wide end 6 width of about 9½ inches, a narrow end 8 width of about 3½ inches, a length of about 23 inches, and a depth of about 3 inches. The dimensions allow a user to squeeze a pair of levers 26, 28 which pivot from the first and second ears 37, 39.

On either side of the housing 4 are located a pair of levers 26 and 28. Lever 26 is pivotally attached to a first pivot slot 22 between one of the pair of first ears 37 and one of the pair of second ears 39, while lever 28 is pivotally attached to second pivot slot 24 between an opposite one of the pair of first ears 37 and the opposite one of the pair of second ears 39. Each lever 26, 28 provides an arm end 50, 51 respectively and a string bar end 20, 21 respectively, each string bar end 20, 21 having pivot apertures 54, 55 respectively, therein. Each pivot aperture 54, 55 selectively aligns with the first pivot slot 22 and the second pivot slot 24. A bolt 60 removably engages the first pivot slot 22 and the pivot aperture 54 of lever 26, while another bolt 60 removably engages the second pivot slot 22 and the pivot aperture 55 of lever 28. Each arm end 50, 51 terminates in an outwardly turned curve 56 to conform to a user's hand. Normally, the "default" position of each of the levers 26 and 28 are almost parallel to the length-wise dimension of the housing 4. Squeezing either or both of the levers 26, 28 causes the corresponding string bar end 20, 21 to move slightly away from the narrow end 8 thereby increasing tension on the selected strings.

The stringed musical toy 2 has four internal strings 13, 14, 15, and 16 located within the housing 4. The strings are accessible through an opening 18 located on the front panel 19. Each string 13-16 has two ends comprising a first end and a second end. The first end of each string is removably attached to a tuning peg 9-12, respectively. The tuning pegs are associated with the narrow end 8 of the housing 4. A bridge 40 runs continuously across the width of the housing 4 hollow interior 35 near the narrow end 8 between the tuning pegs and the opening 18. The strings 13-16 run continuously from the first end to the second end, crossing over the bridge 40 therebetween.

The second end of each string 13-16 is connected to a string bar end 20, 21 by stringing the string through holes in the string bar end. In use the string bar ends 20, 21 are internally located within the housing 4. A string bar stop 25 limits the movement of the string bar ends 20, 21 towards the narrow end 8 of the housing 4.

Squeezing lever 26 changes the pitch of strings 15 and 16, while squeezing lever 28 changes the pitch of strings 13 and 14. In effect, each of the levers 26, 28 serves as a partial tremolo bar for the two strings that are attached to it, allowing an individual to modify the pitch at will for the attached strings.

The housing 4 also has a back panel 30 that can be removed allowing an individual to access all components within the housing 4.

The stringed musical toy 2 also has an acoustic output jack 32 that is attached to the wide end 6 of the housing 4. The acoustic output jack 32 can be used to connect the stringed musical toy 2 to an external device 34 as needed. The external device 34 can be any one of a wide variety of items, including but not limited to an amplifier, signal processing unit, recorder, or other related items.

Operation:

To use the present string musical toy 2, strings 13-16 must be attached. To attach the strings, a user removes each lever 26, 28 from the wide end 6 of the housing 4. The user then attaches the second end of each string 13-16 with the second end of strings 15 and 16 removably attached to the appropriate string bar end through the string holes. Each lever 26, 28 is then removably reattached to the wide end 6 of the housing. Then, the first end of each string 13-16 is pulled over the bridge 40 and attached to a tuning peg 9-12, respectively. The excess string exits the narrow end 8 of the housing 4. To play the toy 2, a user plucks the strings 13-16 to create notes while squeezing on the levers 26, 28 to selectively change the pitch of the notes played on the strings 13-16.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. A stringed musical toy comprising:

a tapered housing having a narrow end and a wide end;

a hollow interior defined within the housing;

a set of string disposed within the housing;

a front panel and a back panel of the housing, wherein the front panel comprises an opening located along a midline between the narrow end and the wide end, whereby a user can access the set of strings;

a pair of vertically aligned first and second ears disposed on the wide end of the housing;

a pair pivot slots located through the ears;

a pair of bolts removably received though the slots whereby a pivot point is created;

a pair of levers pivotally contained within the pivot slots, each lever comprising an arm end disposed outside the housing and a string bar end comprising means for attaching the strings;

wherein the arm ends comprise a curve whereby a user's hand rests comfortably thereon;

a string bar stop located proximal to the wide end thereby limiting the movement of the string bar end in a direction towards the narrow end;

a plurality of tuning pegs located at the narrow end of the housing;

a bridge located proximal to the tuning pegs;

wherein the strings attach at one end to the tuning pegs and at the other end to the string bar ends;

wherein the strings are disposed against the bridge.

2. A method of playing the toy of claim 1 comprising the steps of:

attaching a set of strings to the string bar ends;

inserting the string bar ends into the housing;

connecting the lever to the housing at the pivot point;

connecting the other end of the strings to the tuning pegs;

adjusting the tuning pegs whereby tension is placed upon the strings;

plucking the set of string located within the housing;

squeezing the arm end of the lever whereby the string end is displaced outwardly from the narrow end of the housing and tension is increased upon the strings resulting in a change in pitch of the strings;

relaxing pressure on the arm end of the lever;

allowing the string tension to return the string bar to the string stop bar.

* * * * *